US010779620B1

(12) United States Patent
Johnson

(10) Patent No.: US 10,779,620 B1
(45) Date of Patent: Sep. 22, 2020

(54) ASSISTIVE CANE FOR VISUALLY IMPAIRED WITH PROGRAMMABLE LIGHTING

(71) Applicant: Nicholas A. Johnson, Portland, OR (US)

(72) Inventor: Nicholas A. Johnson, Portland, OR (US)

( * ) Notice: Subject to any disclaimer, the term of this patent is extended or adjusted under 35 U.S.C. 154(b) by 0 days.

(21) Appl. No.: 16/805,750

(22) Filed: Feb. 29, 2020

Related U.S. Application Data

(60) Provisional application No. 62/816,123, filed on Mar. 9, 2019.

(51) Int. Cl.

| | |
|---|---|
| ***A45B 3/04*** | (2006.01) |
| ***A61H 3/06*** | (2006.01) |
| ***F21V 23/04*** | (2006.01) |
| ***F21L 4/02*** | (2006.01) |
| ***F21Y 107/30*** | (2016.01) |
| ***F21Y 115/10*** | (2016.01) |
| ***F21Y 113/13*** | (2016.01) |

(52) U.S. Cl.
CPC ..... *A45B 3/04* (2013.01); *A61H 3/068* (2013.01); *F21L 4/02* (2013.01); *F21V 23/0407* (2013.01); *F21V 23/0414* (2013.01); *F21V 23/0435* (2013.01); *A61H 2201/0188* (2013.01); *F21Y 2107/30* (2016.08); *F21Y 2113/13* (2016.08); *F21Y 2115/10* (2016.08)

(58) Field of Classification Search
CPC .. A45B 4/04; A61H 3/068; A61H 2201/0188; F21L 4/02; F21V 23/0407; F21V 23/0414; F21V 23/0435; F21Y 2107/30; F21Y 2113/13; F21Y 2115/10
USPC ..... 362/102
See application file for complete search history.

(56) References Cited

U.S. PATENT DOCUMENTS

| | | | | |
|---|---|---|---|---|
| 5,810,466 | A * | 9/1998 | Young | A45B 3/04 135/66 |
| 10,159,315 | B1 * | 12/2018 | Digiorgio | A45B 3/04 |
| 2014/0268713 | A1 * | 9/2014 | Unger | F21V 23/0414 362/205 |

FOREIGN PATENT DOCUMENTS

| | | | | |
|---|---|---|---|---|
| WO | WO-2019001997 | A1 * | 1/2019 | F21V 19/04 |

* cited by examiner

*Primary Examiner* — Cara E Rakowski
*Assistant Examiner* — Jessica M Apenteng
(74) *Attorney, Agent, or Firm* — Mersenne Law

(57) ABSTRACT

An illuminated, multi-function cane for use by low-vision individuals is described and claimed. The device's various pulsating lights enable low-vision people to travel at night with assured confidence that they will be seen by drivers and cyclists from a safe distance exceeding one mile on a dark street! While at a high traffic lit city intersection the Lumi cane is very noticeable with its strobing rainbow lights 200 yards away, even with competition from other bright artificial lights. Even in dense fog Lumi's LED lights are visible at 40 to 75 yards distance.

18 Claims, 8 Drawing Sheets

ASSISTIVE CANE FOR VISUALLY IMPAIRED WITH PROGRAMMABLE LIGHTING

CONTINUITY AND CLAIM OF PRIORITY

This is an original U.S. patent application that claims priority to U.S. provisional patent application 62/816,123 filed 9 Mar. 2019, the disclosure of which is incorporated by this reference.

FIELD

The invention relates to safety devices and assistive devices for the visually impaired. More specifically, the invention relates to safety advances in canes suitable for use by the blind, low-vision and other users with visual impairments.

BACKGROUND

In the past centuries, people did use sticks to travel when blind. But in 1921 John Biggs, a photographer, painted his walking stick white after going blind. And after World War Two white Canes became very popular for returning blind soldiers. In 1972 the white canes for the blind became federally regulated. But it would take a generation before the white cane could embrace the Techno generation in the new millennium. Or more white canes.

I've been blind for over 20 years due to Glaucoma and shared life experience with my close-knit blind community of companions. We all have one problem in common, it's fear of night travel, considering we are a prime soft target for criminals! We need one hand free to use the White Cane at all times. So, it's quite impractical having a cell phone that flashes a light then drains your battery very quickly. It's not a reasonable solution for safe night travel considering that the flashing cell phone only strobes about one hour. And we Blind People use our cell phones twice as much as sighted people.

After I went blind in April of 2000 I still wanted to maintain a social night life. But after being run down by 3 cyclists, and nearly hit by half a dozen vehicles while crossing at various intersections. These experiences caused me to search the Internet for years and found nothing satisfactory that would solve my problem. The present invention was created to fill my need, and it may be of great value for helping other blind and visually-impaired people to travel at night.

SUMMARY

Lumi 2.0 is a flashing handle for a white cane. It is very practical and convenient. Even if Lumi stops flashing, the reflective white tape on the cane will permit night travel with no less safety than prior-art canes. Lumi is essential for night travel and practical for day usage. If your cell phone battery dies and needs a charge, just plug it into Lumi 2.0 USB port, located on the handle and charge it up. You can give your cell phone one full charge and Lumi 2.0 will still flash for your safety. Lumi is also affordable in price for people on a fixed income.

Lumi 2.0 is essential and practical for night travel for the blind and visually impaired. With an added bonus its day usage your cell phone can be charged by plugging your phone into the built in USB Port. So, if your battery dies and needs a charge, just plug it into Lumi 2.0 USB port, located on the top portion of the handle and charge it up. You can give your cell phone one full charge and Lumi 2.0 will still flash for several hours. Lumi 2.0 handle detaches from the white cane easily by unscrewing the three taught screws located at the bottom of the handle.

Another version of Lumi 2.0 listed in this application describes an attachable coupling that fits on the white cane and slides into the handle and the taught screws will tighten up the handle to the white cane. Many couplings can be made to fit on the user's additional other white canes, since most Blind People have more than 3 white canes.

There are four versions of Lumi 2.0. Version one and two describes the detachable LED Handle with a removable coupling that fits permanently on the user's white cane with cement glue. This version of Lumi 2.0 has either a remote control that operates the lights; or, is made with two buttons near the top of the handle. The power button is slightly larger and by pressing it once Lumi lights up and pressing the button again turns the handle off. The second button has 3 settings. Setting one flashes each color of the Rainbow consecutively, setting 2 strobes each rainbow color and the 3$^{rd}$ setting causes the various 7 colors to fade one color into another. Version three and four also are a detachable LED Handle that's made with a remote controller; or, in the style of two push button type. But there is no coupling needed because the three taught screws tighten to the white cane directly but the handle end is formed in the shape mirroring the coupling. Making the coupling and handle one unit! Even though this type of handle will only fit 2 or 3 types of white canes, most Blind People only use several types of canes. Thereby, saving the user money with no need to purchase other couplings.

If you were fearful to leave your home at night because the thought of being hit by a speeding unseen motorist and thought of walking your pet at night terrifies you for fear of muggers. There is now Lumi 2.0 for added assurance and confidence you will be seen clearly and recognized by anyone within 50 yard distance away. The flashing colored lights actually draw attention to the user.

Most motorists see flashing red lights and relate them to other vehicles or cyclists. When you see a flashing yellow light, your brain is notified that caution is needed. But when anyone sees the 7 colors of the Rainbow flashing, strobing or fading in and out one color at a time, this causes drivers and other pedestrians to take notice! Since the winter of 2019 I've Beta tested Lumi 2.0 and my sighted companions with me always commented that everyone that drove by was looking at Lumi flashing. The psychology behind this phenomenon is just like the Rainbow in the sky. Everyone that sees the Rainbow in the clouds are transfixed because of its uncommon and unique beauty. Lumi 2.0 duplicates the same majestic aesthetics which cause the looker to focus in on the flashing Rainbow lights. By having this effect, the Lumi user is now brought into their attention and becomes much safer! Plus, if you're lost while hiking, in the forest, or lost in the snowy mountains, or stranded on the river or sea, Lumi's flash last for hours! Flares go out in minutes. And you only have so many flares at hand. Anyhow, how many Hikers or Hunters carry flares? Lumi 2.0 can detach from your white cane and attach to your belt loop for Ambulatory travelers.

Embodiments of the invention are illuminated canes featuring multi-colored, optionally flashing or strobing LED lights that can be seen at night by motorists from substantial distances. These devices help make the blind or low-vision individuals using them more easily apparent to motorists and cyclists, to improve the users' safety.

DETAILED DESCRIPTION

Embodiments of the invention are stiff, lightweight canes or rods, suitable for use as a walking cane for a blind or visually-impaired individual. Most users prefer a cane that is slightly shorter than the user is tall, but the length of an embodiment does not substantially affect the novel features described herein. Embodiments may be made in a variety of lengths to suit users of varying heights, as well as varying preferences.

For convenience and ease of handling, the main body of the cane may be separated into shorter segments (e.g., three to five segments, each roughly ⅓ to ⅕ of the overall length). For rapid assembly, the segments may be joined together by an elastic cord or bungee, which holds the segments together when mating slip joints at each segment end are aligned and assembled. Other assembly/disassembly mechanisms may also be used. For example, concentric, telescoping sections may slide together to form a single shorter segment, or be extended to form the full-length cane.

Most of the cane body is coated with a white or retroreflective surface. A portion of the distal segment of the cane may be coated with a contrasting color, such as red or yellow. The contrasting color may also be treated with a retroreflective material so that it appears brighter when illuminated at night, say, by a vehicle headlight.

Figure 1:
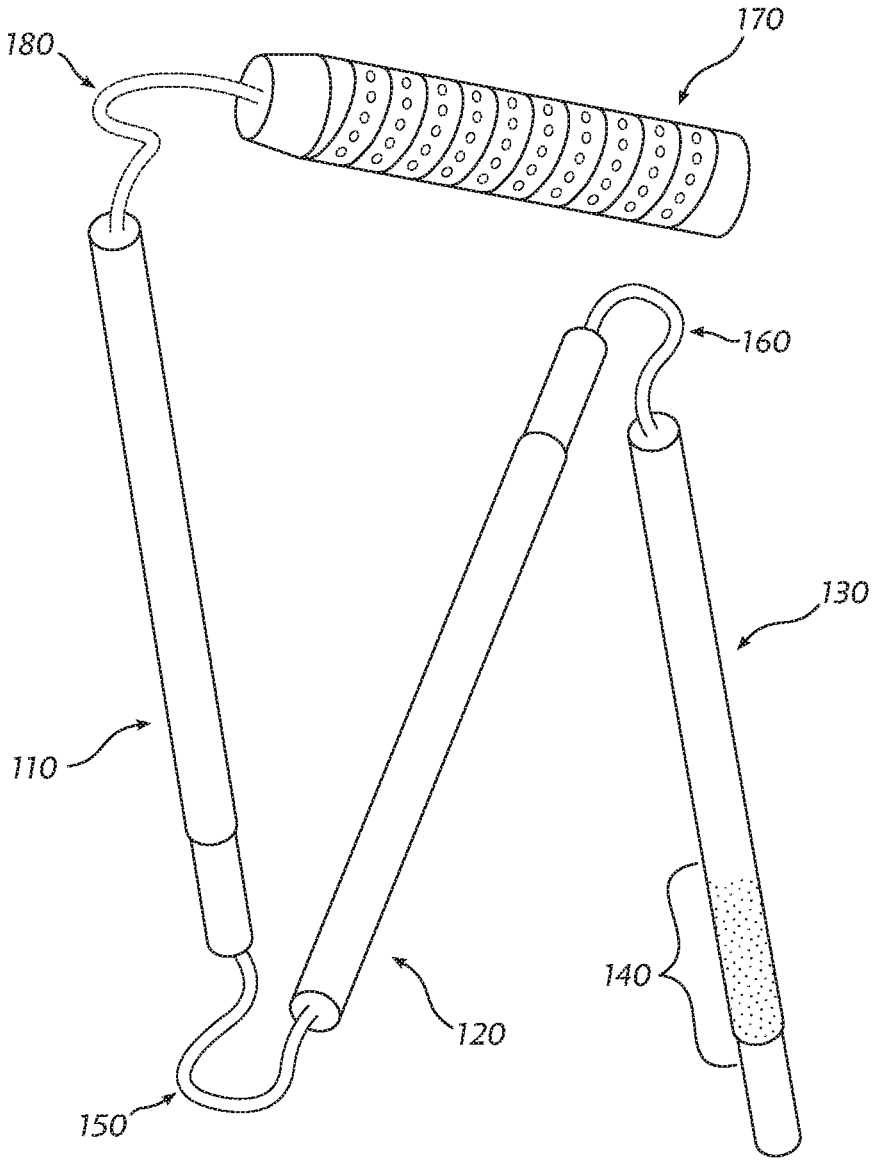
FIG. 1 is an overview drawing of an embodiment.

FIG. 1 shows an exemplary embodiment of the invention, which has been partially broken down as discussed above. This embodiment comprises four segments: segments 110, 120 and 130 are connected together by elastic cords 150 and 160. Slip joints at the end of each segment mate with the adjacent end of the neighboring segment and can be assembled to form a single stiff, lightweight rod. A portion of distal segment 130, identified as 140, may be coated with a contrasting color (most of segments 110, 120 and 130 may be a retroreflective or bright white).

Finally, there is a handle 170 which may be coupled to the proximal end of segment 110. Like the other segments, handle 170 may be connected to its adjacent segment by an elastic cord or bungee 180. Handle 170 is preferably larger in diameter than the other segments, and configured to be easy to grip so that the completely-assembled cane can be manipulated as a single, lightweight rod.

The segments, and thus most of the cane, may be made of fiberglass, carbon fiber, aluminum, magnesium, or another similar material. Strength, light weight, resilience and toughness are desirable characteristics of the cane material. The handle should be strong and sturdy, but because it is directly held and manipulated by the user, it need not be optimized for light weight. (It is appreciated that an excessively heavy handle might make the entire cane tiring to use, but most standard materials and construction techniques for the handle and its components yield a structure that is satisfactory for its intended use.)

In FIG. 1, handle 170 is depicted having a spiral wrapping of small circular devices. These circles represent multi-colored light emitters, such as light-emitting diodes (LEDs). Multi-colored LEDs are often comprised of two, three or four emitters of a single color (e.g., red, green and blue emitters), which are located close together and which can be operated together to emit a wide range of colors. The handle of an embodiment is thus capable of emitting colored light, in the manner and circumstances detailed below.

Note that a light-emitting cane according to an embodiment of the invention is significantly different from traditional walking canes and staffs. First, both canes and staffs are of heavier construction, as they are leaned upon to support part of the user's body weight. In contrast, embodiments of the invention are much lighter—their intended use is to probe an area in front of the user for obstacles. A cane or staff capable of supporting the user's weight would be too heavy to function as a probe; and a probe would quickly fail if called upon to support the user.

Second, canes according to an embodiment are much longer/taller than a traditional walking cane (although it is acknowledged that some walking staffs may be a similar length). And finally, embodiments of the invention are illuminated at the top, handle end; while some prior-art walking canes are provided with illumination at the lower end, to assist in placing the cane on a stable surface that will bear the user's weight, and to help the user see where to step. "Step visualizing" illumination is of little or no use to blind users. Instead, the illuminated handle, at the top end of a longer cane, allows the user to place the cane on the ground and hold the illuminated portion out and up, where it is more visible to others.

Figure 2:
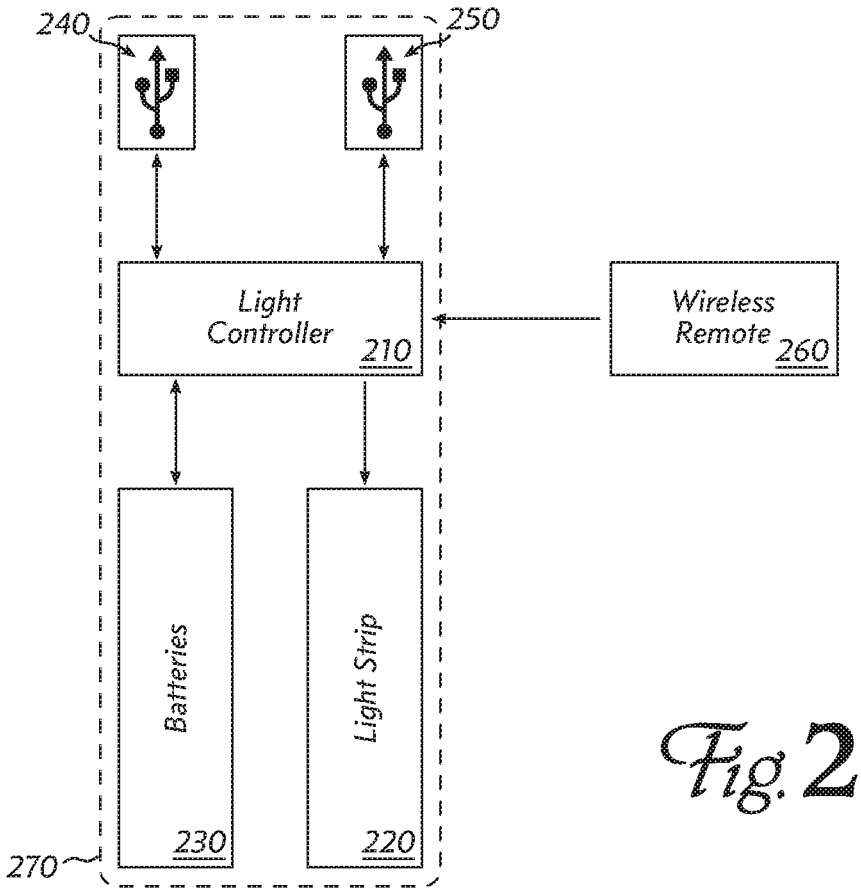
FIG. 2 is a block diagram showing how subsystems may be configured in an embodiment.

FIG. 2 is a block diagram showing some portions of an embodiment. The logical heart of an embodiment is a light controller 210, which is coupled to a power source such as batteries 230, and to a light strip 220. The light controller is also coupled to a plurality of Universal Serial Bus ("USB") connectors 240, 250. Finally, a remote control device such as wireless remote 260 can be used to send control signals to light controller 210 to adjust its operations (e.g., to turn it on or off, or to cause it to display particular illumination patterns). All of light controller 210, batteries 230, light strip 220, and USB connectors 240, 250 may be packaged together as 270—an object having the form and configuration of handle 170 in FIG. 1.

Figure 3:
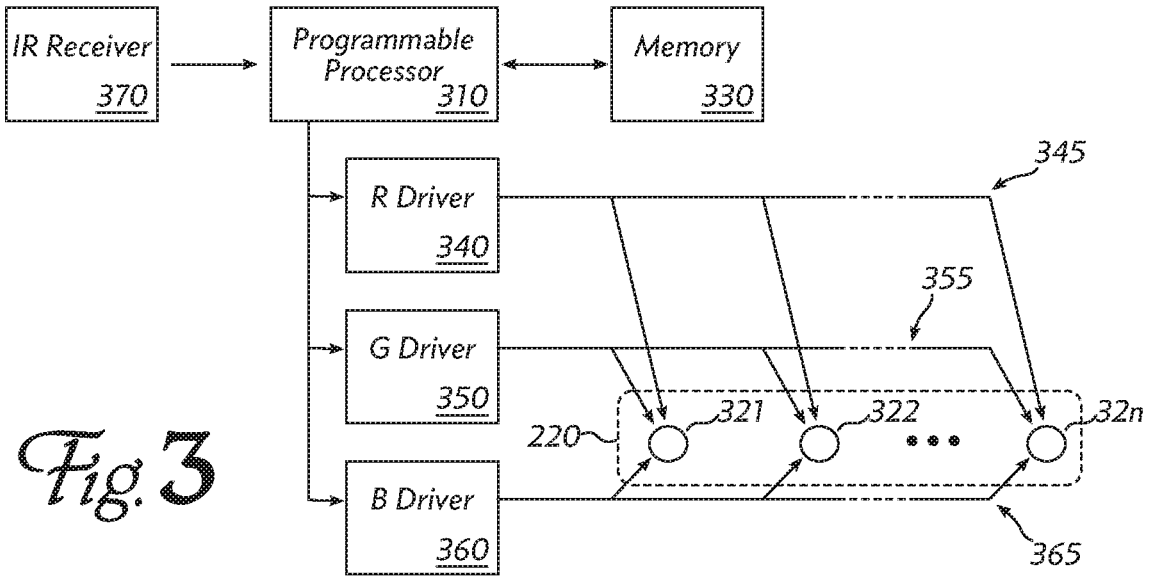
FIG. 3 is a detailed block diagram showing some internal features of an embodiment.

FIG. 3 is a block diagram showing some substructure of FIG. 2's light controller 210 and light strip 220. A programmable processor 310, such as a central processing unit ("CPU"), a microcontroller, or a similar device coordinates the operation of other parts of the system, generally according to instructions and data stored in memory 330 which is accessible to the programmable processor. A plurality of light drivers: R Driver 340, G Driver 350 and B Driver 360 are coupled to the programmable processor 310 and permit the processor to deliver control signals to a plurality of illumination devices 321, 322, . . . 32*n*, over signal lines 345, 355 and 365. Illumination devices (such as red-green-blue LEDs or multicolor LEDs) may be packaged together into a linear array 220, which is referred to herein as a "light strip." Preferably, the light drivers allow programmable processor 310 to set the color and intensity of each illumination device independently, although in a basic embodiment, all illumination devices may be the same color, and may all be on or off at the same time.

In a preferred embodiment, programmable processor 310 is able to emit signals that are coupled to the illumination devices via the drivers 340, 350, 360 as pulse-width modulated (PWM) signals. PWM signals allow the light controller to vary the brightness of each individual illumination device from 0% (off) to 100% (brightest illumination). With independently-variable color channels, a wide gamut of colors can be produced by LEDs that only have three or four primary emission colors. Further, with individually-addressable lights, the light controller can create patterns of multiple colors, of colors and unilluminated segments, and flashing patterns in one or more colors. One striking pattern appears when most of the LEDs of the light strip are illuminated in a first color, but a few adjacent LEDs are illuminated in a second, different color. Then the light strip is controlled so that the adjacent, differently-colored LEDs appear to move or "walk" from one place on the strip to another.

Figure 4:
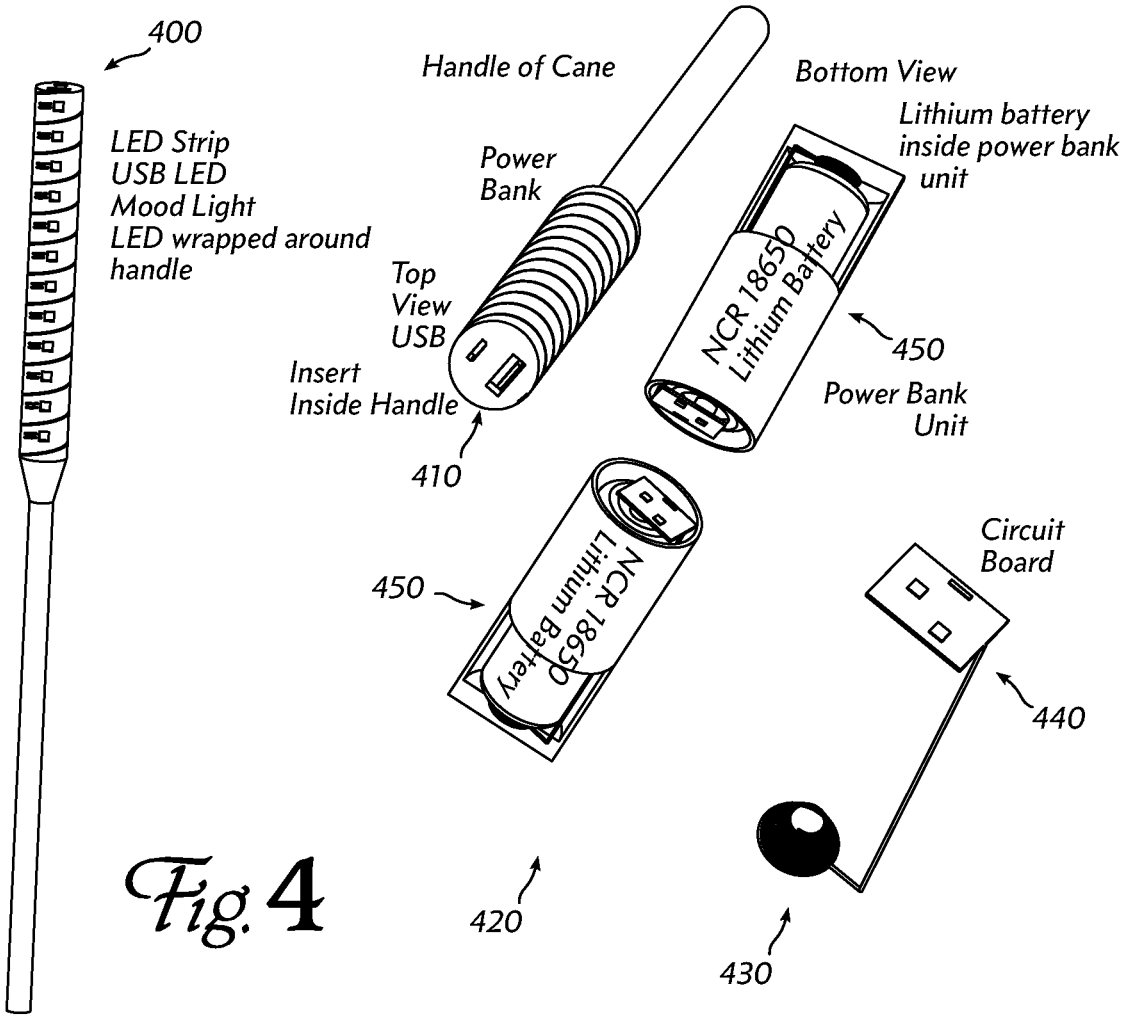
FIG. 4 illustrates several details of an embodiment

FIG. 4 shows details of a number of features of an embodiment. At 400, one can see how a lighting strip may be wrapped around the handle in a spiral. 410 shows the proximal end of the handle, where a plurality of USB ports may be exposed to the user. These ports may be used to recharge the battery, or to charge an auxiliary device using the embodiment's batteries. Thus, for example, an embodiment may be used as an emergency power bank for charging a cell phone.

Elements 450 are batteries, which may be type 18650 lithium-ion batteries. These cells have good power density, so they can operate the device for an extended period of time, and they are of a suitable diameter to fit in a comfortably-sized cylindrical handle.

The lighting controller of an embodiment may be a small circuit board 440, which is placed at the proximal end of the handle.

Figure 5:
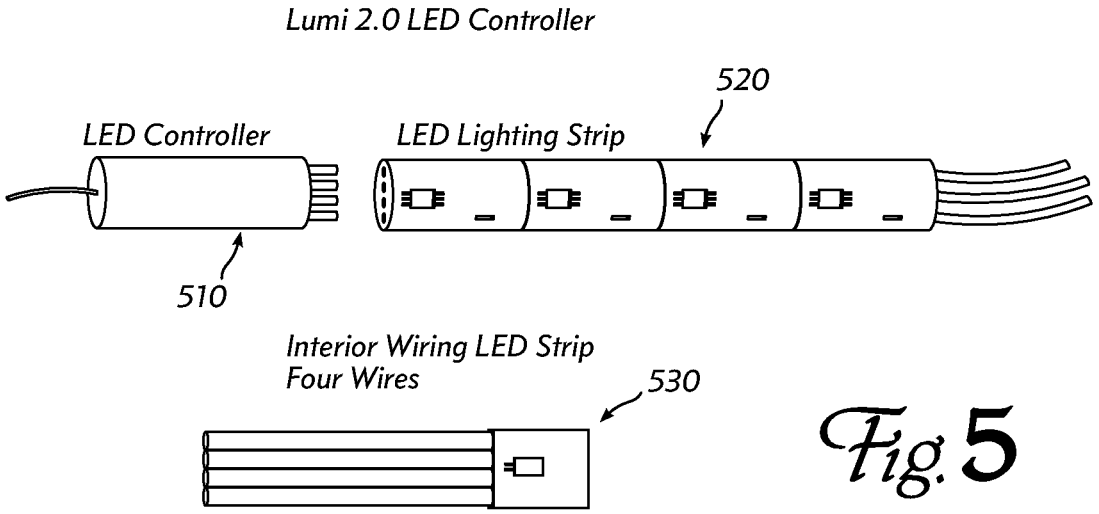
FIG. 5 shows an exemplary control module and lighting strip.

FIG. 5 shows details of a suitable lighting (LED) controller 510, and its connection to a LED lighting strip 520. One embodiment uses a four-wire connection between the controller and the light strip, as shown at 530.

Figure 6:
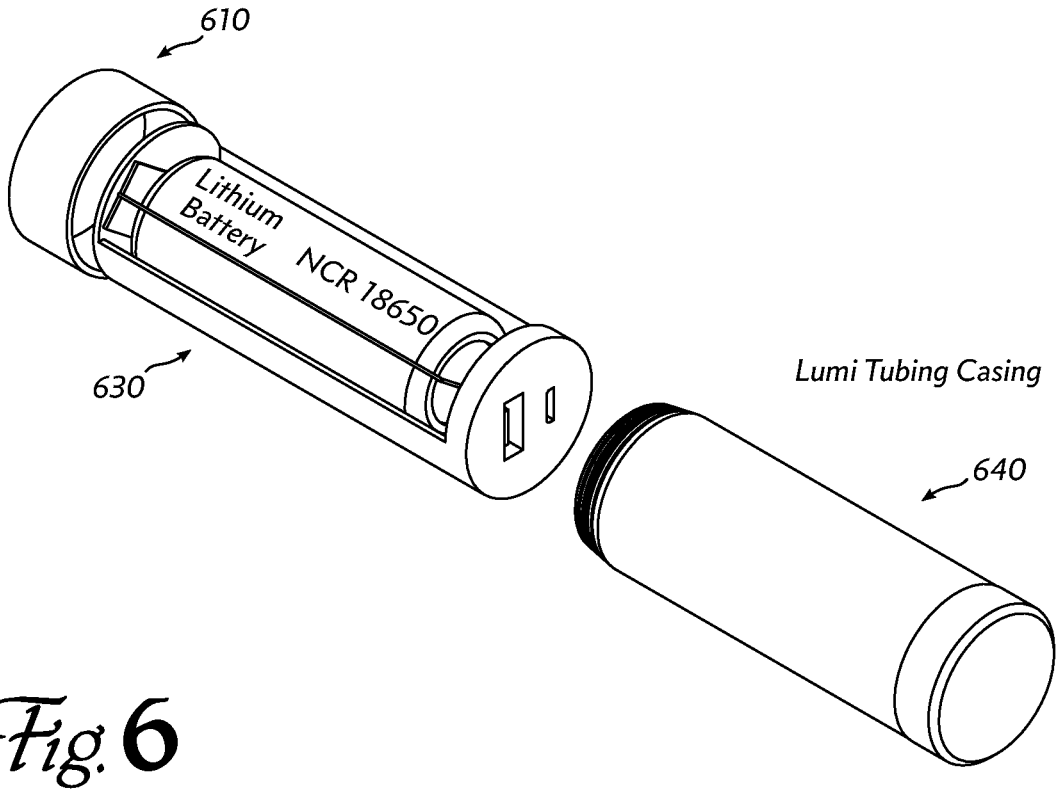
FIG. 6 is a partially-exploded view of a handle of an embodiment.
Figure 7:
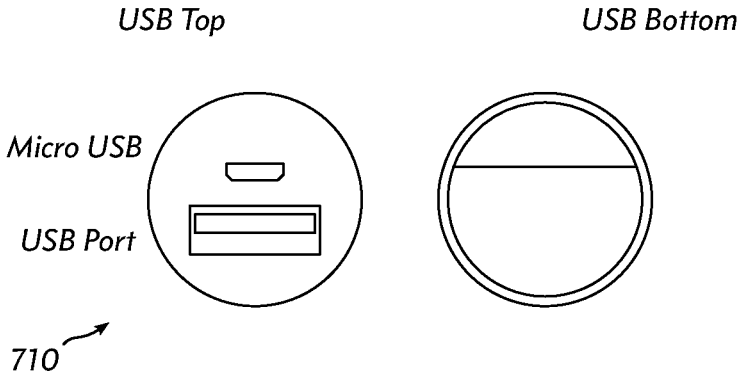
FIG. 7 shows how USB ports may be positioned on an embodiment.

FIG. 6 shows another partially-disassembled handle, with a cap 610 at the proximal end. Batteries and other components 630 are assembled into a hollow tube casing 640, and the light strip is wrapped around the tube (not shown in this Figure). The length of the handle of an embodiment may be from about 10" to about 18", and the diameter of the handle is from about 1.5" to about 2.5". A large proportion of the handle interior is occupied by the batteries, so a longer and/or larger handle can hold more batteries and the embodiment can function for a longer period of time before recharging. FIG. 7 is a larger-scale view of the end of the handle. In some embodiments, heterogenous USB ports (i.e., type A and micro ports) may be provided to increase flexibility for the user.

Figure 8:
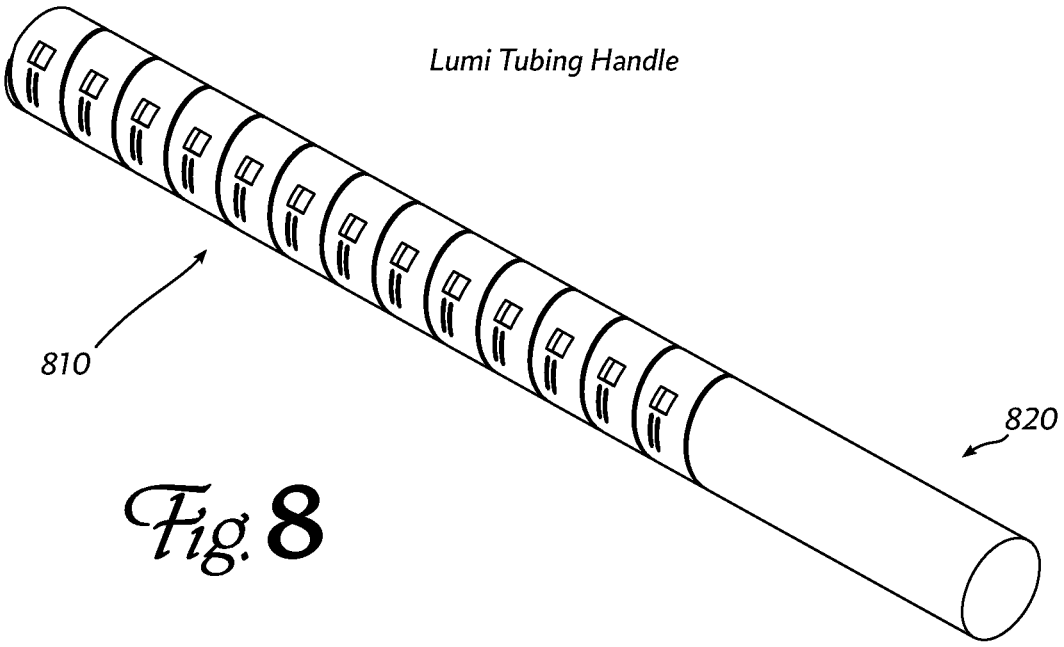
FIG. 8 shows how a lighting strip may be wound around the handle of an embodiment.

FIG. 8 shows another view of the light strip 810 wrapped around the tubular handle 820. The wrapping direction of the spiral may be counter-clockwise, as shown here (from left to right), or may be clockwise. For durability and water resistance, the handle and light-strip assembly may be covered by transparent or translucent heat-shrink tubing.

Figure 9:
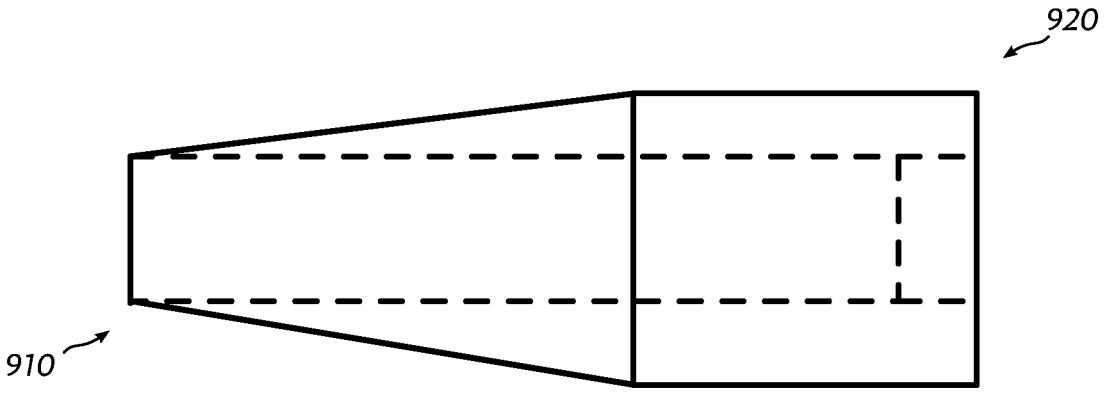
FIG. 9 shows a coupler that may be used to connect the handle of an embodiment to the extended multi-segment rod.

FIG. 9 shows a roughly conical adapter that may be installed to couple the multi-segment cane rod (not shown, but inserted at 910) to the tubular handle (also not shown, but connected at 920).

Figure 10:
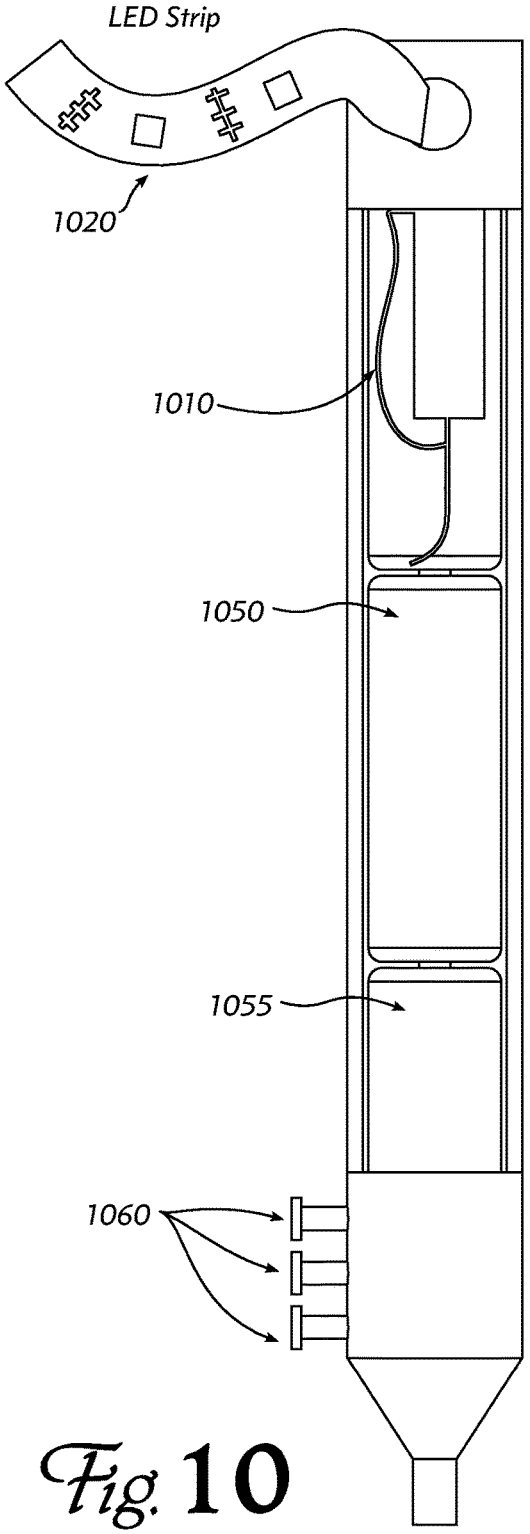
FIG. 10 shows a partially cutaway assembly diagram.

FIG. 10 is a partially cutaway assembly diagram of an embodiment. Shown in this Figure are the LED controller 1010, LED strip 1020 (not yet wrapped around the handle), and batteries 1050 and 1055. The handle of this embodiment is secured to the proximal cane segment by set screws 1060.

Figure 11:
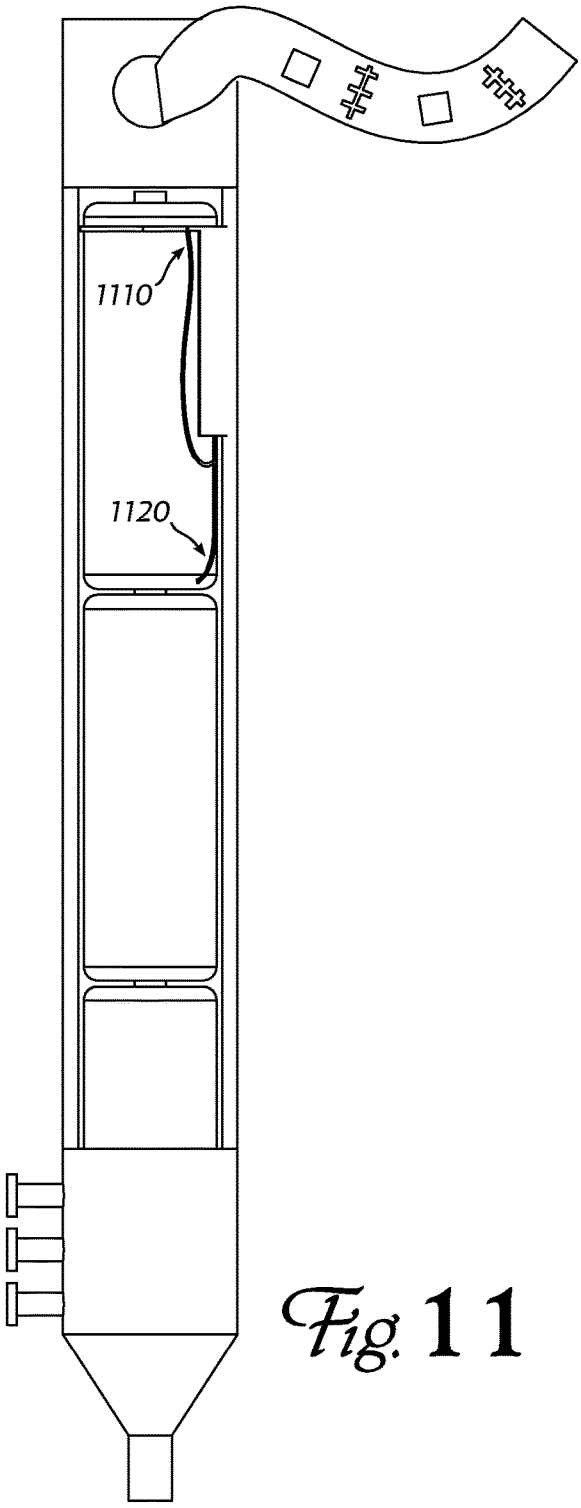
FIG. 11 shows another partially cutaway assembly diagram.

FIG. 11 shows another partially cutaway assembly drawing, showing where the red (positive) power lead 1110 and black (negative) power lead 1120 may be located.

Figure 12:
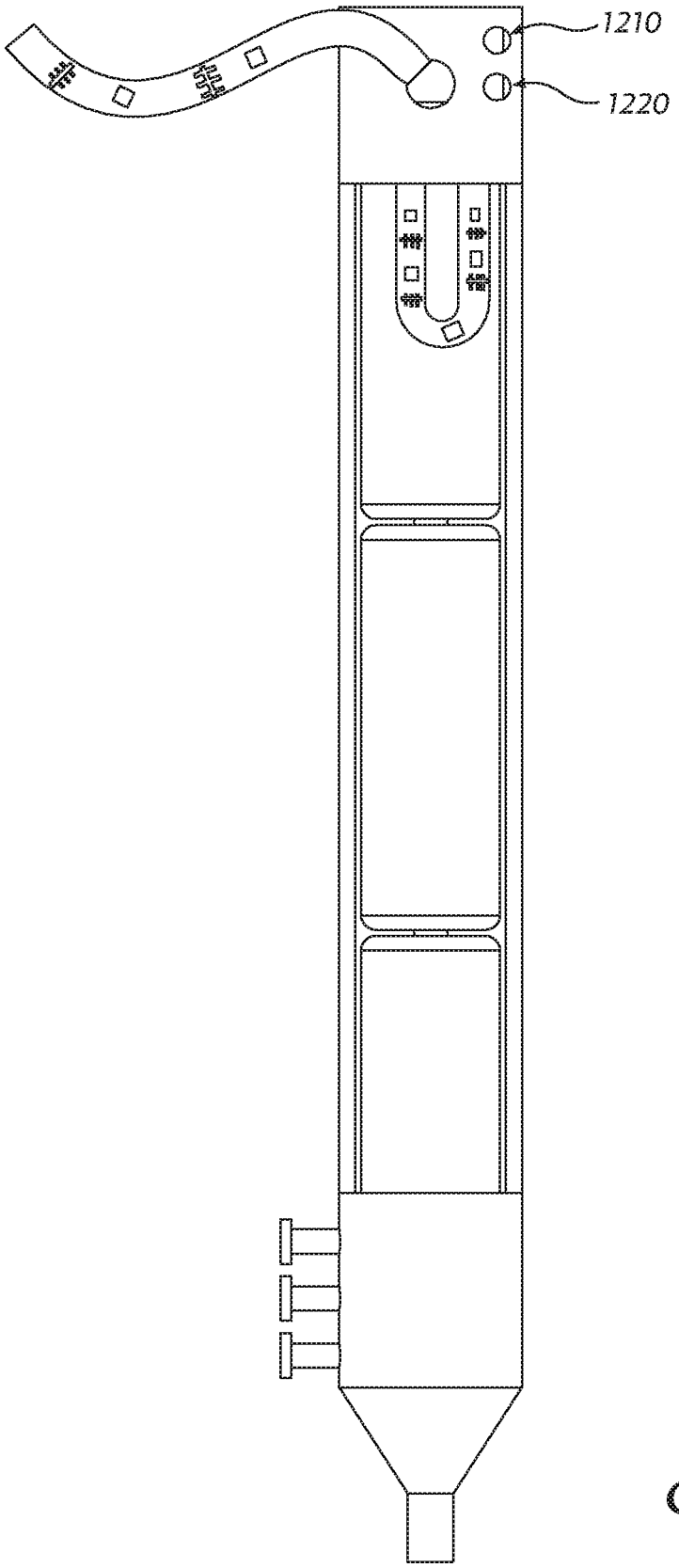
FIG. 12 shows the user controls of a different embodiment.

Although embodiments where the user has a wireless (e.g., radio or infrared) remote control to operate the illumination patterns are preferred, an embodiment may also have user controls built into the handle, as shown in FIG. 12. There, a power button 1210 turns the illumination on or off; while a selection button 1220 cycles between illumination modes, including a solid-color illumination, a flashing illumination, and a "chaser" illumination.

In one embodiment, the Lumi 2.0 White Cane is comprised of 5 graphite composite tubular sections. Each section length is 14 inches with a diameter of ⅜ inch. The cane can vary in total length by increasing or decreasing each section length for various user size or eliminating one section completely. One side of each section is fitted with a metal sleeve, male, ¾ inches in length, that slides over the tube. On the opposite end there is a protective circular plastic sleeve, female, ½ inch in length that slips over the male section of the other tube. This protects the metal from rust and causes the other section to slip smoothly together. There is a bungee cord 30"×¼" inches double looped running through each hollow graphite tube. At each end of the cane the loops fasten to a metal circular fitting that clips on to the cord, holding the elastic cord taut.

This construction allows the user to pull out each section of the cane and fold the sections for easy storage. And by releasing the folded sections the white cane will quickly snap back together in place. This allows the user to feel the ground for cracks holes curbs textile markings and other objects that would impede the user's progress.

The construction of the modified standard handle is unique and state-of-the-art! The power source is two or three lithium 18650 batteries, depending on the overall length of the White Cane, connected in parallel which interact with a remote receiver located on the top part of the handle. The cane lights are activated by a remote control pad powered by a lithium CR2025 battery. The remote control pad signals the remote receiver and light controller using an infrared signal. There are 24 selections on the control pad.

Starting from left to right on the top; button 1 speeds the lights up, second button slows the speed of the lights down; third button turns the lights off; and the fourth button turns the lights on. All other buttons operate various colors and flash settings. Lumi 2.0 has 5 flash settings located directly under the on button. One setting causes the rainbow lights to flash seven different colors consecutively. Pressing another selection button causes one color to fade into another using seven different colors of the Rainbow spectrum. The third button selection flashes red blue and green. The fourth selection causes a white light to glow while the fifth button selection causes the lights to flash. Color range is purple, blue, turquoise, green, yellow, orange and red. There are 15 different color button selections directly under the top control buttons and to the left of the flash settings. However, when these are pressed, the flash settings are deactivated changing to one solid color only and no flash or strobe can be produced. The control pad has four top buttons and six buttons to the left. The control pad is 3¼" by 2" by ¼", fitting comfortably in your palm.

The two or three lithium 18650 batteries are housed snugly in a hard tubular plastic case, with the bottom end closed, fitting tightly against the $5^{th}$ section of the cane. The plastic housing containing the two or three lithium batteries is cemented to the $5^{th}$ section of the cane making it the core of the handle. Two USB ports are hard wired to the lithium batteries using 18 gauge wires. One USB port is standard size and the other is a micro port. The led multi color lights are in a 6 foot×⅜ inch plastic strip connecting to the circuit board that houses the remote receiver which connects to the lithium batteries. The LED lighted strip is wrapped around the $5^{th}$ section of the cane including the plastic battery housing unit making it the handle; to be held by the user. The USB ports are located on the very top section of the cane and the circuit board lays on top of the lithium battery under the two USB ports. This unit is called the power bank. Connecting the lithium batteries in parallel boosts the 3.8 to 5.1 volts when charging a cell phone. The USB ports are protected with a soft plastic circular form fitted seal which fits around the USB ports into the tubular battery housing unit. Waterproofing the electronics. They're covered by a clear plastic cap that protects the USB ports. The cap can be removed to recharge the cane or a cell phone. Clear shrink wrap, 15×2 inches is slipped over the handle and heated. Thereby, water proofing the LED lights and making the handle easy to grip. The Lumi 2.0 White Cane comes with remote control.

The second version of Lumi 2.0 has two push button switches connecting side by side to each other at the top of the handle. The larger button is a power switch type on/off-off/on, rated 5 millivolts @ 0.5 amps operating the LED lights. Button two, has 3 function selections controlling the lights flashing, strobing or fading. These buttons are seated on a micro circuit board which the buttons are seated on. Two wires run from the micro circuit board. The positive wire connects to the positive wire from the Lithium battery, while the neutral wire from the micro circuit board connects to the LED lights. There are several styles of detachable Lumi 2.0 White Canes. The first style has an attachable coupling that connects the handle to the white cane. Type two style handle is form fitted and shaped at the end as if the coupling is one unit with the handle. Both versions of the handle have two types of operating the lights. One by remote and the other by push button switch.

Figure 13:
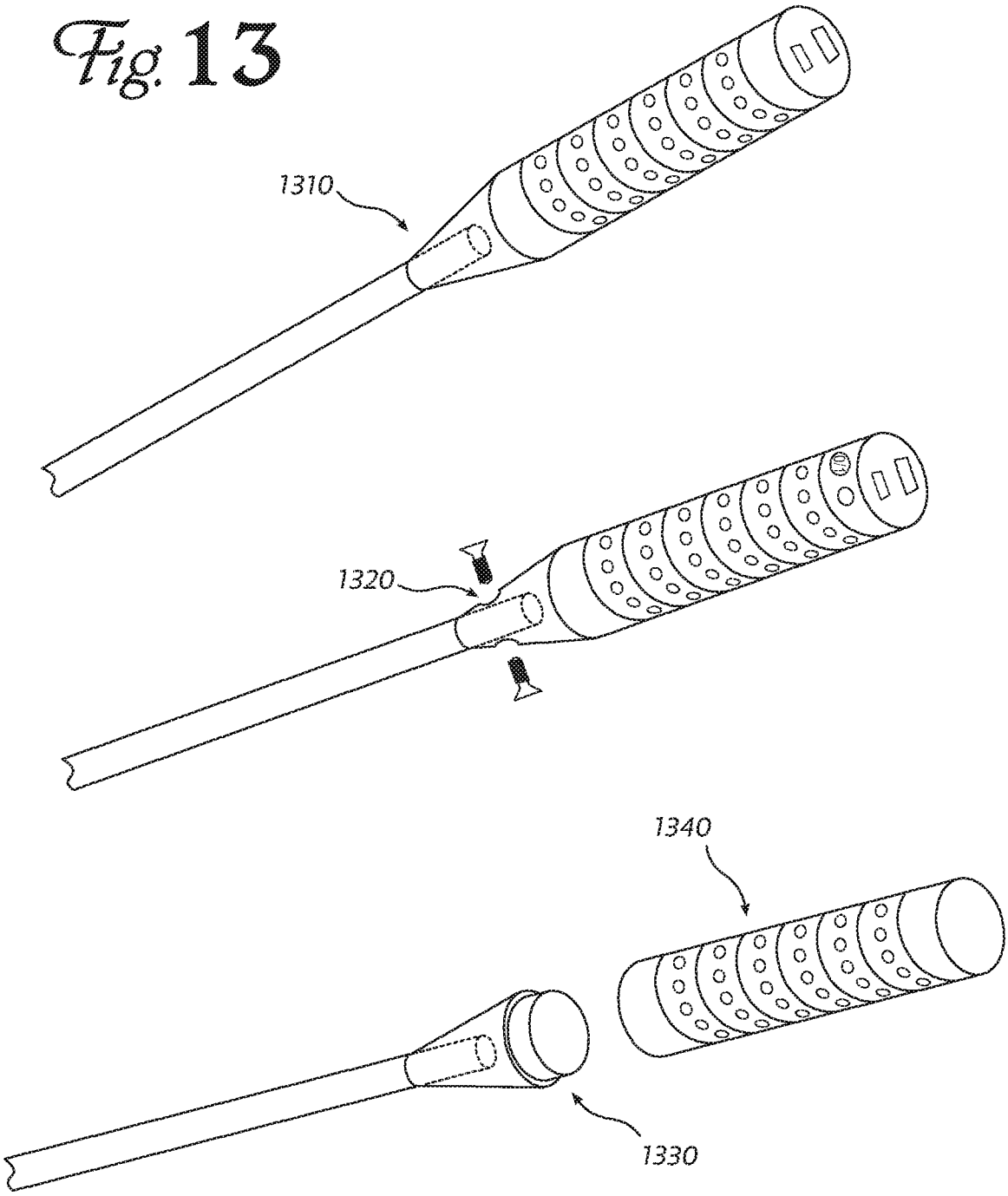
FIG. 13 shows several alternative coupling mechanisms.

FIG. 13 shows several different coupling mechanisms that an embodiment may use to secure the illuminated handle to the body of the cane. The simplest, 1310, uses a friction fit coupling, which may be cemented for permanence. Another embodiment may use set screws 1320 to attach the handle—this embodiment can be disassembled to replace a damaged or broken cane. Finally, a conical adapter 1330 (similar to FIG. 9) may be secured to the cane, and a self-contained handle 1340 may connect to the adapter through a slip fit, friction fit, or screw-thread attachment. Other attachment mechanisms will be apparent to those of ordinary skill in the art.

The applications of the present invention have been described largely by reference to specific examples and in terms of particular allocations of functionality to certain hardware and/or software components. However, those of skill in the art will recognize that a highly visible white cane for the visually impaired can also be produced by software and hardware that distribute the functions of embodiments of this invention differently than herein described. Such variations and implementations are understood to be captured according to the following claims.

I claim:

1. An illuminated walking cane comprising:

an illuminated handle;

a sturdy, lightweight rod coupled to the illuminated handle; and a control mechanism adapted to activate, adjust, and deactivate the illuminated handle, wherein the illuminated handle further comprises:

a light controller;

a battery coupled to the light controller; and a light strip coupled to the light controller, and wherein the light controller comprises:

a programmable processor;

a memory coupled to the programmable processor and containing data and instructions for the programmable processor; and a multi-channel proportional power driver to activate a plurality of separate color channels of the light strip.

2. The illuminated walking cane of claim 1 wherein the light strip comprises a plurality of discrete multi-color light-emitting diodes ("LEDs"), each discrete multi-color LED having a red emitter, a green emitter and a blue emitter.

3. The illuminated walking cane of claim 1 wherein the light strip is wound about the illuminated handle in a spiral pattern.

4. The illuminated walking cane of claim 3 wherein the spiral pattern is clockwise.

5. The illuminated walking cane of claim 3 wherein the spiral pattern is counter-clockwise.

6. The illuminated walking cane of claim 1 wherein the data and instructions include code to illuminate the light strip in a color chosen from the group consisting of white, red, green, blue, yellow, aqua, and purple.

7. The illuminated walking cane of claim 1 wherein the data and instructions include code to cause the light strip to flash.

8. The illuminated walking cane of claim 1 wherein the data and instructions include code to cause the light strip to fade from a first color to a second, different color.

9. The illuminated walking cane of claim 1 wherein the data and instructions include code to cause a first portion of the light strip to glow in a first color, and a second distinct portion of the light strip to glow in a second, different color.

10. The illuminated walking cane of claim 1 wherein the data and instructions include code to cause the light strip to glow a first color over most of a length of the light strip, with a traveling segment of a second different color appearing to move along the length of the light strip.

11. The illuminated walking cane of claim 1 wherein the data and instructions include code to cause the light strip to flash.

12. The illuminated walking cane of claim 1 wherein the battery comprises a plurality of 18650 lithium-ion battery cells.

13. The illuminated walking cane of claim 1 wherein the illuminated handle comprises a plurality of Universal Serial Bus ("USB") ports, and wherein one USB port of the plurality of USB ports is capable of charging an auxiliary device; and one USB port of the plurality of USB ports is capable of charging the battery coupled to the light controller.

14. The illuminated walking cane of claim 1 wherein the control mechanism communicates with the light controller via an infrared signal.

15. A safety assistive device for blind and low-vision users, comprising:

an illuminated handle;

a multi-segment rod coupled to the illuminated handle; and a wireless remote control for adjusting visual characteristics of the illuminated handle, wherein the illuminated handle is between 10" and 15" long, the multi-segment rod consists of at least three but no more than five sub-segments;

each of the segments of the multi-segment rod is connected to at least one adjoining segment by an elastic cord;

the multi-segment rod, when assembled, is between five (5) and seven (7) feet long, and the illuminated handle displays a first color over a first portion of a surface of the illuminated handle, and a second, different color over a second, different portion of the surface of the illuminated handle, said first color and said second, different colors selected by the wireless remote control.

16. The safety assistive device of claim 15 wherein the wireless remote control comprises twenty-four (24) selections, and wherein a first button increases a flashing frequency of the illuminated handle, a second button decreases the flashing frequency of the illuminated handle, a third button turns off the illuminated handle, and a fourth button turns on the illuminated handle.

17. The safety assistive device of claim 16, wherein the wireless remote control further comprises fifteen (15) color selection buttons to set a color of the illuminated handle.

18. A safety assistive device for blind and low-vision users, comprising:

an illuminated cylindrical handle having a length between 10" and 18" and a diameter between 1.5" and 2.5", wherein one end of the cylindrical handle is adapted to be secured to a white cane via a connection chosen from the group consisting of a permanent cemented coupling, a removable two-part coupling where one part is cemented to the white cane, a slip-fit coupling to a shaft of the white cane, a slip-fit coupling to an original handle of the white cane, and a coupling secured to the white with set screws;

another end of the cylindrical handle comprises at least two Universal Serial Bus ("USB") ports;

an oblong strip of light-emitting diodes ("LEDs") is secured around an outer surface of the cylindrical handle;

the cylindrical handle houses a power source comprising at least two lithium batteries;

the cylindrical handle houses a control unit that is coupled to the oblong strip of LEDs and operative to cause the oblong strip of LEDs to display colored illumination patterns on the cylindrical handle, the cylindrical handle further comprising a transparent or translucent protective coating covering the oblong strip of LEDs.

* * * * *